United States Patent [19]

Naito

[11] Patent Number: 4,546,345

[45] Date of Patent: Oct. 8, 1985

[54] THEFT PREVENTING DEVICE

[75] Inventor: Hiroyasu Naito, Saitama, Japan

[73] Assignee: Honda Giken Kogyo Kabushiki Kaisha, Tokyo, Japan

[21] Appl. No.: 407,430

[22] Filed: Aug. 12, 1982

[30] Foreign Application Priority Data

Aug. 13, 1981 [JP] Japan ..... 56-127348

[51] Int. Cl.[4] ..... E05B 45/06; E05B 73/00; G08B 13/18

[52] U.S. Cl. ..... 340/542; 70/18; 70/DIG. 49; 70/DIG. 51; 340/555; 340/693

[58] Field of Search ..... 70/18, DIG. 49, DIG. 51; 340/542, 384 E, 555, 691, 693

[56] References Cited

U.S. PATENT DOCUMENTS

| | | | |
|---|---|---|---|
| 3,714,644 | 1/1973 | Hellstrom | 340/542 X |
| 3,772,645 | 11/1973 | Odenz et al. | 70/18 X |
| 3,824,540 | 7/1974 | Smith, II | 340/693 X |
| 3,828,340 | 8/1974 | Bauer, Jr. et al. | 70/DIG. 51 X |
| 3,993,987 | 11/1976 | Stevens | 340/542 |
| 4,057,986 | 11/1977 | Zolke et al. | 70/18 X |
| 4,262,284 | 4/1981 | Stieff et al. | 340/542 X |
| 4,399,430 | 8/1983 | Kitchen | 340/555 |

FOREIGN PATENT DOCUMENTS

| | | | |
|---|---|---|---|
| 1077597 | 5/1980 | Canada | 340/555 |
| 1252100 | 10/1967 | Fed. Rep. of Germany | 70/DIG. 49 |
| 0739206 | 6/1980 | U.S.S.R. | 70/DIG. 49 |

*Primary Examiner*—James L. Rowland
*Assistant Examiner*—Thomas J. Mullen, Jr.
*Attorney, Agent, or Firm*—Irving M. Weiner; Joseph P. Carrier; John J. Cantarella

[57] ABSTRACT

A theft preventing device comprising a lock body, a cable member having one end fixed to the lock body and the other end fastenable to the lock body to bring the device into a locking position, and an alarm system contained in the lock body. The alarm system includes an alarm device, a drive circuit for the alarm device, and an inhibiting circuit for the drive circuit. The inhibiting circuit is completed by means of a light-conducting member extending through and along the cable member. Maximized alarming effects against various means of theft are achieved, and thus the device suitably prevents an object to be protected from being stolen.

7 Claims, 3 Drawing Figures

THEFT PREVENTING DEVICE

BACKGROUND OF THE INVENTION

1. Field of the Invention

The present invention relates to a theft preventing device, and more particularly to a theft preventing device of a chain locking type which employs a cable member therein.

2. Description of Relevant Art

Theft preventing devices of a chain locking type are already known in which one end of a cable member having the other end fixed to a lock body is linked around an object, such as a bicycle or the like, and is lockably fastened to the lock body to prevent the object from being stolen. The lock body is additionally provided with an alarm or warning device which will alert as to possible breakage of the cable member when the device is in a locking position to perfect the theft preventing function of the device.

In such conventional theft preventing devices, a cable has an electric conductor extending therealong which completes an inhibiting circuit for inhibiting operation of an alarm or warning device, and is energized when the device is in its locking position. These theft preventing devices, however, are disadvantageous in that an additional bypass circuit can easily be provided to such an electric circuit, which will render the warning or alarm device inoperable.

The present invention resolves such problems of these conventional theft preventing devices.

SUMMARY OF THE INVENTION

The present invention provides a theft preventing device comprising a lockable lock body, a cable member having one end thereof secured to the lock body, and the other end thereof fastenable to the lock body. At least one light-conducting member extends through and along the cable member. An alarm system is housed in the lock body. The alarm system includes an alarm device, a drive circuit operable to drive the alarm device when the lock body is in its locking position, and an inhibiting circuit for inhibiting operation of the drive circuit, the inhibiting circuit being completed by the light-conducting member.

It is an object of the present invention to provide a theft preventing device of a chain locking type in which ordinary deceiving means cannot substantially hinder generation of warning sound. This makes it difficult to steal the protected object, and gives maximized alarming effects against various means of theft, so that the object can be suitably prevented from being stolen.

The above and other objects, details and advantages of the present invention will become apparent from the following detailed description of a preferred embodiment of the invention, when read in conjunction with the accompanying drawings.

DETAILED DESCRIPTION OF THE PREFERRED EMBODIMENTS

Figure 1:
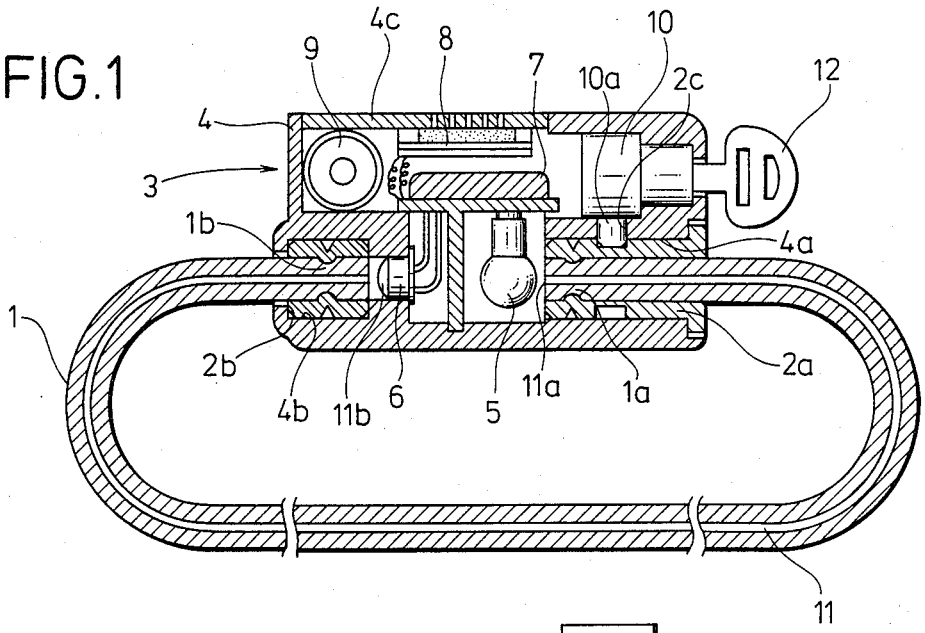
FIG. 1 is an illustrative representation showing the entire system of a theft preventing device according to a preferred embodiment of the present invention.

FIG. 1 shows a preferred embodiment wherein a portable and self-contained theft preventing device includes a chain locking wire cable 1 consisting of steel strands as its main stock. An end 1*a* of the cable 1 extends into and is secured to a fastening metal member 2*a* formed as a cylindrical body having a flange at an end thereof.

The metal member 2*a* has at least one circumferential groove 2*c* formed around a substantially intermediate portion thereof in an axial direction thereof. In a locking position of the theft preventing device, the metal member 2*a* is inserted in a receiving hole 4*a* formed in one side portion of a housing of a lock body 3 and is fastened thereto as described hereinbelow.

The other end 1*b* of the cable 1 extends into and is secured to a mounting metal member 2*b*. End 1*b* extends into an interiorly widened recess 4*b* formed in a side portion of the housing 4 in opposing relationship relative to the receiving hole 4*a*, and is secured thereto.

The cable 1 has at least one optical fiber 11 twisted therewith which serves as a light beam conducting member. The optical fiber 11 extends through and along the cable 1 in a coextensive relationship to one end 11*a* thereof at an outer end face of the end 1*a* of the cable 1 so that, when the metal member 2*a* is fastened, it faces a light-emitting element 5. Element 5 is disposed within the housing of the lock body in confronting relation to an inner proximal end of the receiving hole 4*a*, and serves as a light source. The other end 11*b* of the fiber 11 similarly extends to an end face of the other end 1*b* of the cable 1 and faces a light-receiving element 6 mounted in the interior of the recess 4*b* and serving as a detector.

The housing 4 of the lock body 3 further has securely contained therein an electric circuit unit 7, a sound generating member 8 serving as an alarm member which generates an alarm sound when the cable 1 is broken, a power source 9 which electrically supplies required energy, and a lock cylinder 10 which constitutes a main locking mechanism. The housing 4 is covered with a cover member 4*c* to protect the same from the environment and includes a key receiving hole adjacent the cable receiving hole 4*a*.

The lock cylinder 10 has at least one lock pin 10*a* mounted for movement into and out of the lock cylinder 10 in a radial direction. When a key 12 inserted into the cylinder 10 is turned for locking motion, the pin 10*a* is moved to extend outwardly into the receiving hole 4*a* to engage in the groove 2*c* formed in the metal member 2 so as to fasten the end 1*a* of the cable 1 to the lock body 3.

Figure 2:
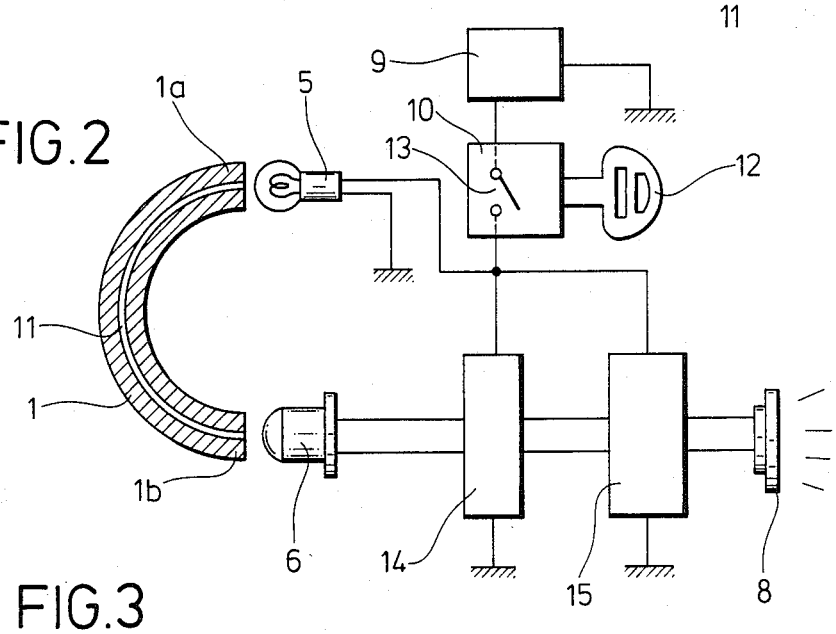
FIG. 2 is a block diagram showing an alarm system of the theft preventing device of FIG. 1.

Referring now to FIG. 2, the lock cylinder 10 has an ON-OFF switch 13 contained therein which is disposed for operation by the pin 10*a* such that the switch 13 is turned ON when the device is brought into a locked position. Upon turning ON of the switch 13, the power source 9 is connected to the light-emitting element 5. An oscillator 15 acts as a drive circuit for the sound generator 8. An amplifier circuit 14 functions as an inhibit circuit for inhibiting oscillation of the oscillator 15 when outputting a predetermined output therefrom. Thus, the timing at which the power circuit is completed by a locking operation of the key 12 is synchronized with the timing at which the lock pin 10*a* is moved into engagement with the groove 2c of the metal member 2a.

The light-emitting element 5 emits light by the completion of the power circuit including power source 9. The light is conducted by and along the optical fiber 11 to pass through the cable 1, and is projected onto the light-receiving element 6. This excites the element 6 so that the light-receiving element 6 generates a voltage in accordance with the amount of light received. Thus, when the device is in the locking position, a closed condition of the amplifier circuit 14 is established due to the photo coupling by the optical fiber 11. Accordingly, so long as the cable 1 is not broken and the locking condition is maintained properly, the light-receiving element 6 will receive a substantially constant amount of light and maintain a predetermined output so that the sound generating member 8 will produce no alarm sound.

On the other hand, if the output of the light-receiving element 6 is reduced so low or even to zero from some cause, then the oscillator 15 will operate to bring the sound generating member 8 into operation to generate an alarm sound. In this respect, it can be considered that causes of reduction of the output of the light-receiving element 6 to such a low level or even to zero include breakage of the cable 1.

Figure 3:
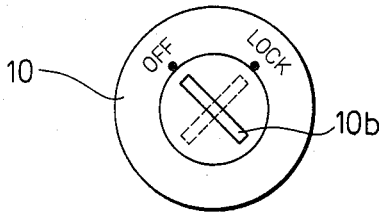
FIG. 3 is a front elevational view of a lock cylinder portion of the theft preventing device of FIG. 1.

Referring now to FIG. 3, the lock cylinder 10 has at a front face thereof a key slot 10b for receiving the key 12 therein and marks "OFF" and "LOCK" for pointing out clearly an initial position and a locking position. The initial position "OFF" provides for opening of the switch 13 and the locking position "LOCK" provides for closing of the switch 13.

Although there has been described what are at present considered to be a preferred embodiment of the invention, it will be understood that the invention may be embodied in other specific forms without departing from the spirit or essential character thereof. The preferred embodiment is therefore to be considered in all respects as illustrative, and not restrictive. The scope of the invention is indicated by the appended claims rather than by the foregoing description.

I claim:

1. A portable and self-contained theft preventing device comprising:

a lockable unitary lock body having a housing;

a lock mechanism disposed in said housing;

a cable member having one end thereof secured to said unitary lock body and the other end thereof fastenable to said unitary lock body;

at least one light-conducting member extending through and along said cable member;

an alarm system contained in said lock body housing;

said housing being formed at one side thereof with a cable receiving hole for receiving said other end of said cable member and a key receiving hole for receiving a key member;

said alarm system including an alarm device, a drive circuit operable to drive said alarm device when said lock body is in its locking position, and an inhibiting circuit for inhibiting operation of said drive circuit, said inhibiting circuit being completed by said light-conducting member;

said inhibiting circuit includes a light-emitting element operable in synchronism with a locking operation to initiate emission of light therefrom, a light-receiving element which generates a voltage in accordance with the amount of light received thereby, and an amplifier circuit connected to said light-emitting element;

said light-emitting element and said light-receiving element being disposed within said housing of said lock body;

said lock mechanism having a lock cylinder which is operable by means of said key member;

said alarm system further including a power source and a switch mechanism interposed between said power source and said drive and inhibiting circuits; and said switch mechanism being operatively associated with said lock cylinder.

2. A theft preventing device according to claim 1, wherein:

said cable member comprises a stranded cable including a plurality of said light-conducting members and a plurality of steel wires, all of which emanate from and return to said housing of said lock body in a locked condition of said device.

3. A theft preventing device according to claim 1, wherein:

said drive circuit includes an oscillator connected to said amplifier circuit, said oscillator oscillating when it receives an input voltage lower than a predetermined level.

4. A theft preventing device according to claim 3, wherein:

said alarm device is connected to said oscillator.

5. A theft preventing device according to claim 1, wherein:

said light-conducting member comprises an optical fiber.

6. A theft preventing device according to claim 1, wherein:

said housing of said lock body has opposite sides formed with, respectively, said cable receiving hole and an opposing widened recess; and said one end of said cable being secured within said widened recess and said other end of said cable being fastenable in said cable receiving hole such that, in a locked condition, said one end and said other end of said cable are in substantially oppositely facing relation; and said cable receiving hole being provided adjacently to said key receiving hole on said one side of said housing of said lock body.

7. A theft preventing device according to claim 1, wherein:

said light-emitting element is disposed within said housing of said lock body in confronting relation to an inner proximal end of said cable receiving hole.

* * * * *